US008191183B2

(12) United States Patent
Campbell et al.

(10) Patent No.: US 8,191,183 B2
(45) Date of Patent: Jun. 5, 2012

(54) SUCTION FITTING FOR BATHING INSTALLATIONS

(75) Inventors: Graham J. Campbell, Stevenson Ranch, CA (US); Jason W. Hillyard, Fillmore, CA (US)

(73) Assignee: G-G Distribution and Development, Co., Inc., Valencia, CA (US)

( * ) Notice: Subject to any disclaimer, the term of this patent is extended or adjusted under 35 U.S.C. 154(b) by 363 days.

(21) Appl. No.: 12/638,784

(22) Filed: Dec. 15, 2009

(65) Prior Publication Data

US 2010/0146696 A1 Jun. 17, 2010

Related U.S. Application Data

(60) Provisional application No. 61/138,481, filed on Dec. 17, 2008.

(51) Int. Cl.
*E04H 4/00* (2006.01)

(52) U.S. Cl. ..... 4/507

(58) Field of Classification Search ..... 4/507, 488, 4/538, 541.6, 541.1, 567–568; 29/428
See application file for complete search history.

(56) References Cited

U.S. PATENT DOCUMENTS

| | | | | |
|---|---|---|---|---|
| 4,115,878 | A * | 9/1978 | Johnson et al. | 4/492 |
| 4,602,391 | A * | 7/1986 | Shepherd | 4/541.4 |
| 5,499,406 | A * | 3/1996 | Chalberg et al. | 4/541.2 |
| 6,038,712 | A * | 3/2000 | Chalberg et al. | 4/507 |
| 7,178,179 | B2 * | 2/2007 | Barnes | 4/507 |
| 7,346,938 | B2 * | 3/2008 | Mattson et al. | 4/507 |

* cited by examiner

*Primary Examiner* — Lori Baker
(74) *Attorney, Agent, or Firm* — Larry K. Roberts

(57) ABSTRACT

A suction fitting assembly for a bathing installation includes a cover with a pattern of orifices, a wall fitting, and an adapter structure. The wall fitting is configured for insertion through a hole in a wall of a bathing water receptacle, and may be secured in place with a locking nut. The cover is fastened to the wall fitting on the bather side of the wall. A suction adapter structure is connected to the wall fitting. A function of the suction adaptor structure is to admit air through an air tube from the atmosphere to the suction line during a blocked condition, rendering pump operation ineffective.

26 Claims, 9 Drawing Sheets

SUCTION FITTING FOR BATHING INSTALLATIONS

CROSS-REFERENCE TO RELATED APPLICATION

This application claims the benefit of U.S. Provisional Application No. 61/138,481, filed Dec. 17, 2008, the entire contents of which are hereby incorporated by reference.

BACKGROUND

Bathing installations such as pools, spas and whirlpool baths typically have a recirculating water system, with a pump in the water flow path to pump water through the water flow path. The system typically includes a suction fitting mounted in the floor or wall of the bathing installation water receptacle, and one or more jets. The suction side of the pump is connected through a suction pipe line to the suction fitting, and the output side of the pump is connected through the pipe system to the one or more jets or other output fittings. The operation of the pump creates a vacuum, drawing water through the suction fitting to the pump, which forces water under pressure through the output fittings or jets into the water receptacle. The vacuum can create safety issues if a person's body, hair or clothing covers the suction fitting, and the vacuum holds the person against the fitting.

Typically, each pump may be connected to two suction sources to comply with regulatory requirements. This may be two suction fittings connected in the wall or floor of a water receptacle, or one suction fitting and a skimmer fitting. Many bathing installations employ two pumps, and the bathing installation would have four suction sources, two for each pump. A typical pump capacity in the spa market is in the range of 200 gallons per minute ("gpm") rating.

A new suction test standard, A112.19.8-2007, has been implemented by the government to address the safety of pool and spa suctions. The standard addresses the possibility of body and hair entrapment. The entire suction is covered by the body block used to simulate body entrapment or may be entirely covered with hair. When the suction is completely blocked, the pump can create a great amount of vacuum to hold the body against the suction fitting. To comply with the new suction standard, using a typical pump, e.g. with a 200 gpm rating and conventional suction fittings, may require additional suction sources, i.e. more than two suction sources. Adding additional suction sources would entail redesign of the bathing installation plumbing system, and locating additional suction sources in a relatively small bathing installation can be problematic.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
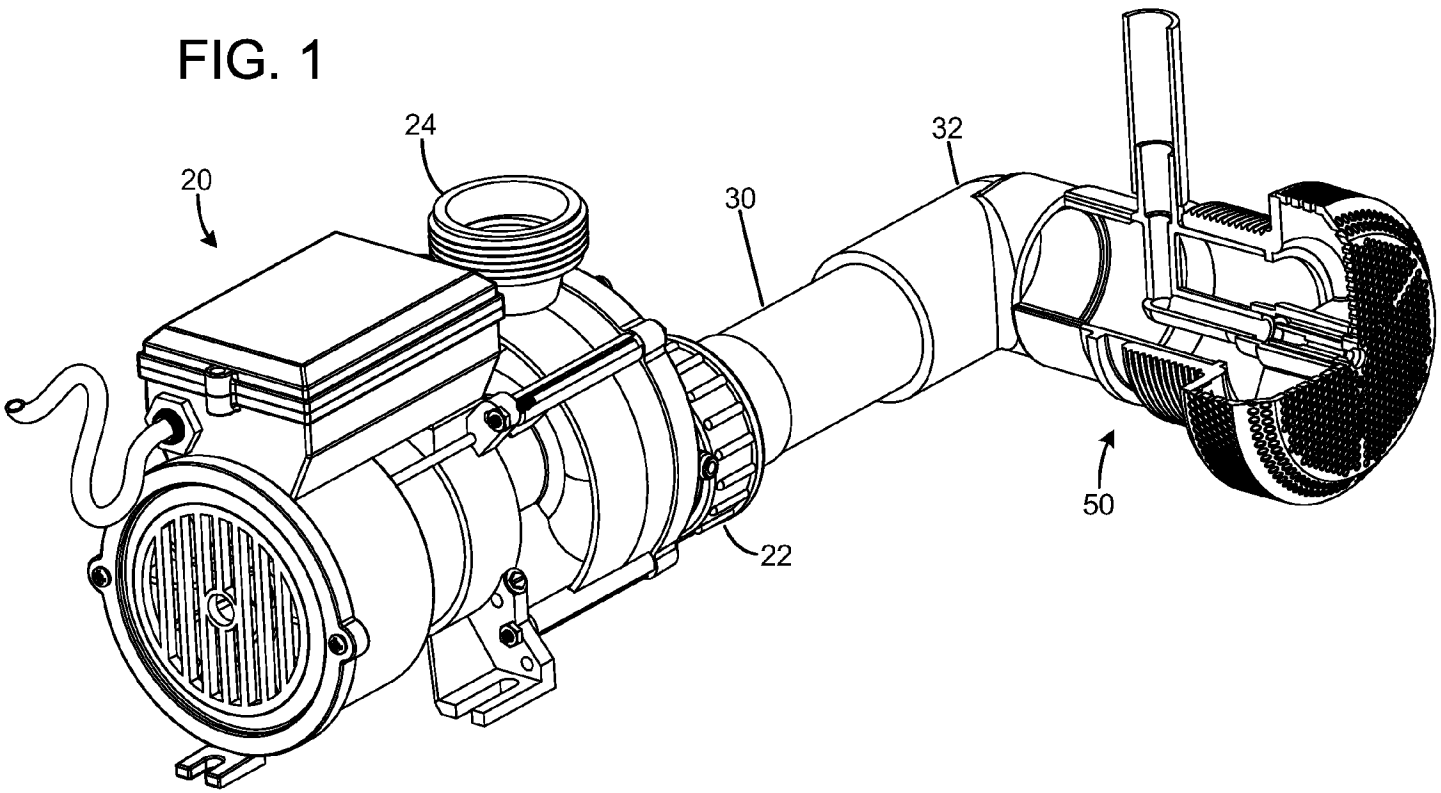
FIG. 1 is an isometric view of an exemplary embodiment of a suction fitting for a bathing installation, connected to a pump.

In the following detailed description and in the several figures of the drawing, like elements are identified with like reference numerals. The figures may not be to scale, and relative feature sizes may be exaggerated for illustrative purposes.

FIG. 1 illustrates features of an exemplary embodiment of a suction fitting assembly 50 for a bathing installation, connected to a suction port 22 of a pump 20 by a pipe system 30. The output port 24 of the pump will be connected to output elements such as jets by another pipe system (not shown in FIG. 1), or in some cases to a filter, connected in a recirculating water flow system. In an exemplary application, the pump 20 may have a capacity rating of 200 gpm, although the suction fitting assembly may be employed with pumps of lower or higher capacity ratings.

Figure 2:
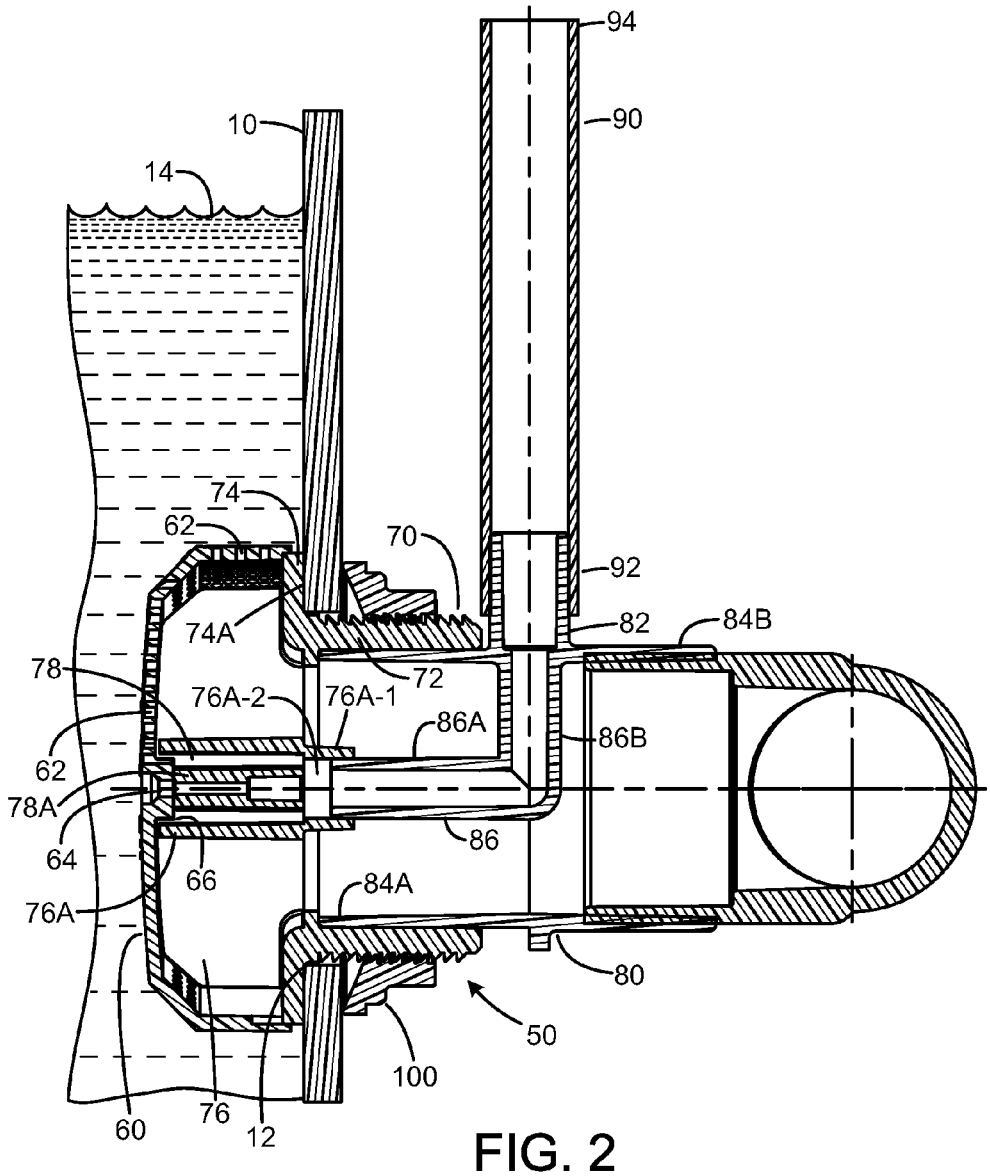
FIG. 2 is a side cross-section view of an exemplary embodiment of a suction fitting installed in a wall of a bathing installation water receptacle.
Figure 3:
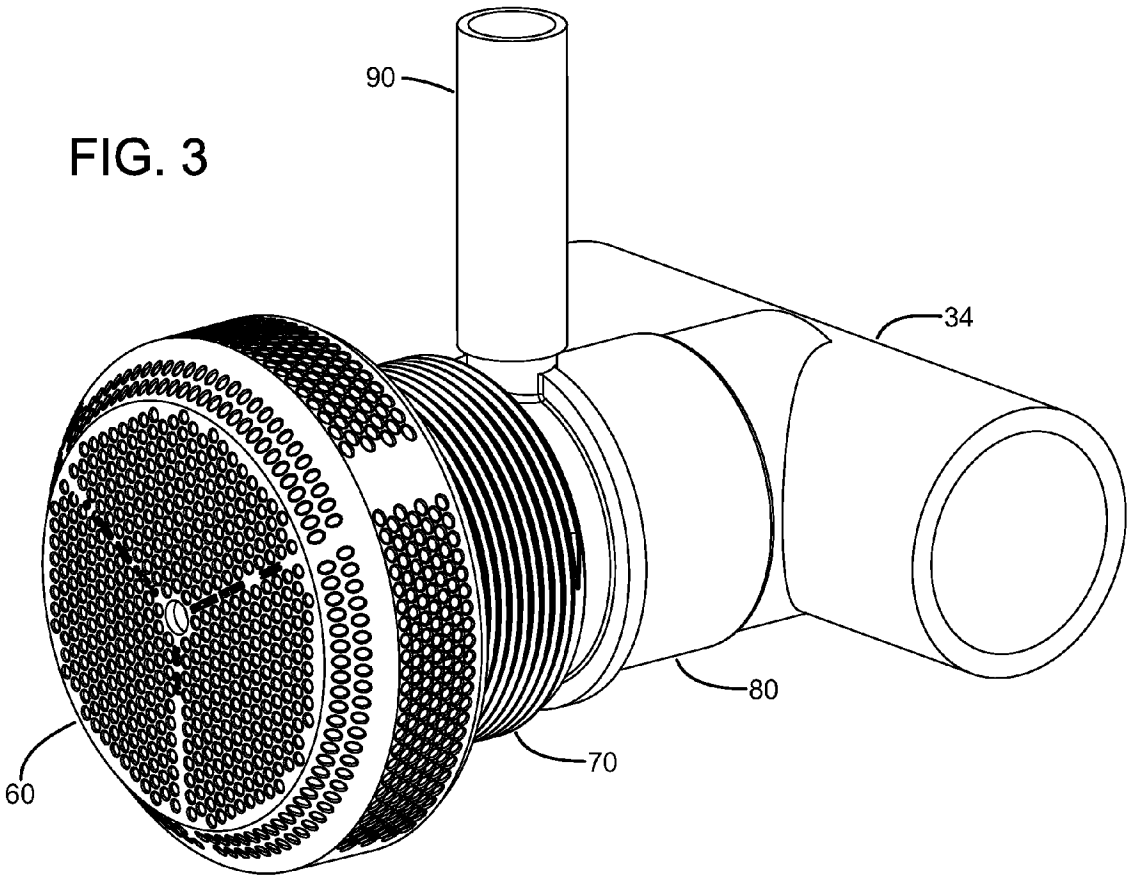
FIG. 3 is an isometric view of an exemplary embodiment of a suction fitting.

In one exemplary embodiment, the suction fitting assembly 50 is configured for installation in a wall of a water receptacle of a bathing installation. The fitting may be adapted for installation in the floor of a tub, as well. FIG. 2 illustrates an embodiment of the fitting 50 installed in a hole 12 formed in the side wall 10 of a water receptacle. The fitting 50 includes a suction cover 60 with a pattern of holes or orifices 62 formed therein to allow water to enter the fitting in normal operation while preventing objects larger than the hole diameter from being sucked into the fitting during pump operation. In an exemplary embodiment, the orifices are arranged on a series of concentric circles, with an orifice diameter of 0.090 inch. A wall fitting structure 70 has a generally cylindrical barrel portion 72 of an outer diameter slightly smaller than the diameter of the hole 12, and a flange portion 74 formed at an end of the barrel portion. The outer diameter of the flange portion is larger than the wall hole diameter, providing a stop surface 74A which engages the interior (water side) surface of the wall 10. The outer surface of the barrel portion is threaded, for engagement with a threaded nut 100 to secure the wall fitting in place in the wall. A centering ring 102, and a gasket 104 (FIG. 7) may be employed to improve the water seal and security of the installation.

The cover 60 is attached to the wall fitting 70 by a threaded fastener (not shown in FIG. 2) such as a screw, passed through center hole 64. The use of a single fastener to attach the cover to the wall fitting reduces cost and improves the appearance of the cover, in contrast with other covers attached with multiple fasteners adjacent the outer periphery of the cover.

The wall fitting structure 70 further includes three vane portions 76 integrally formed with the flange portion 74 and protruding radially outward from a center hollow support structure 76A at 120 degree spacing. The vane portions serve a structural function, with the outer edges contoured to conform to the shape of corresponding inner surfaces of the cover 60. The vane portions support the cover when installed on the fitting and add rigidity to reduce the risk of collapse or breakage of the cover if subjected to contact or impact forces from the water side. The vane portions also structurally support the hollow support portion 76A. Integrally formed within the support portion 76A are three interior radial ribs 78 connected between the inner surface of the tubular portion 76A and an interior hollow tubular portion 78A at 120 degree spacing. The interior opening 78B within the interior hollow portion 78A receives a threaded fastener to secure the cover to the wall fitting structure 70. The interior radial ribs 78 separate the open space between the interior hollow portion 78A and the outer hollow support structure 76A into three open spaces or regions 78A-2.

Figure 5A:
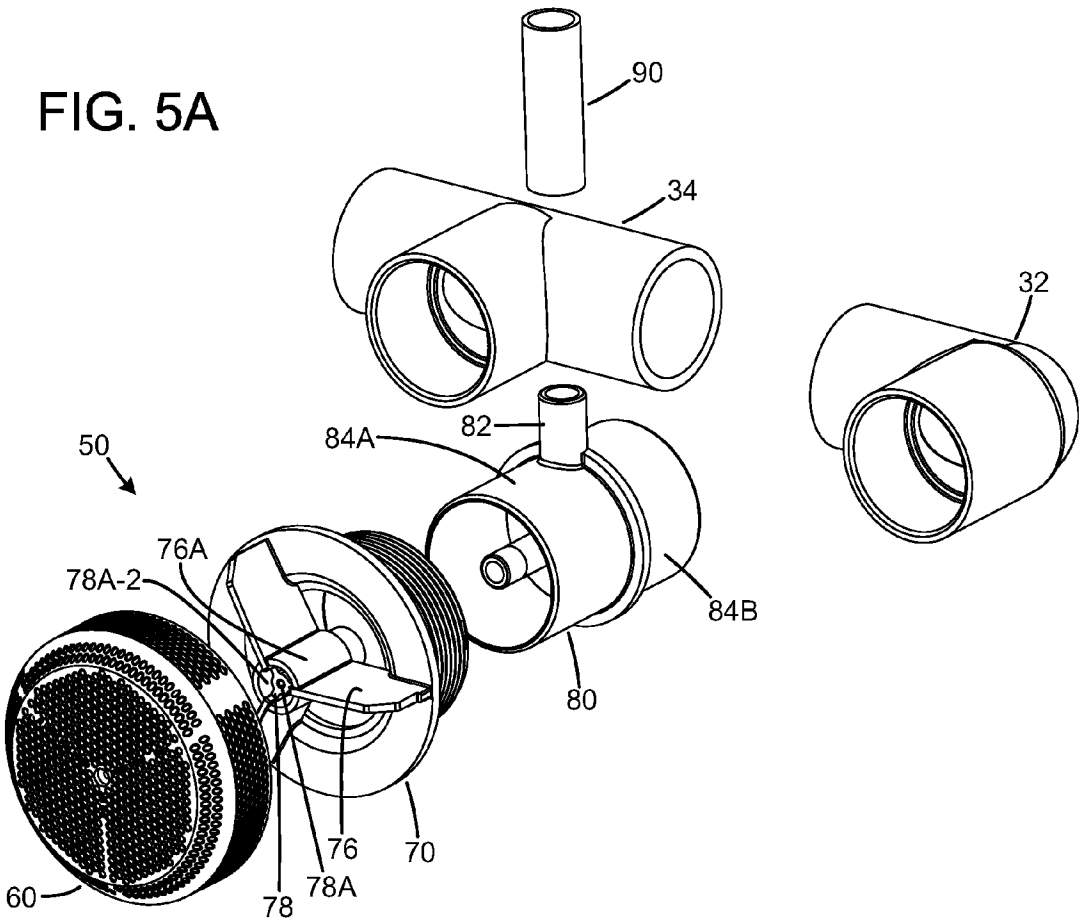
FIG. 5A is a front isometric exploded view of the exemplary suction fitting of FIG. 3.
Figure 5B:
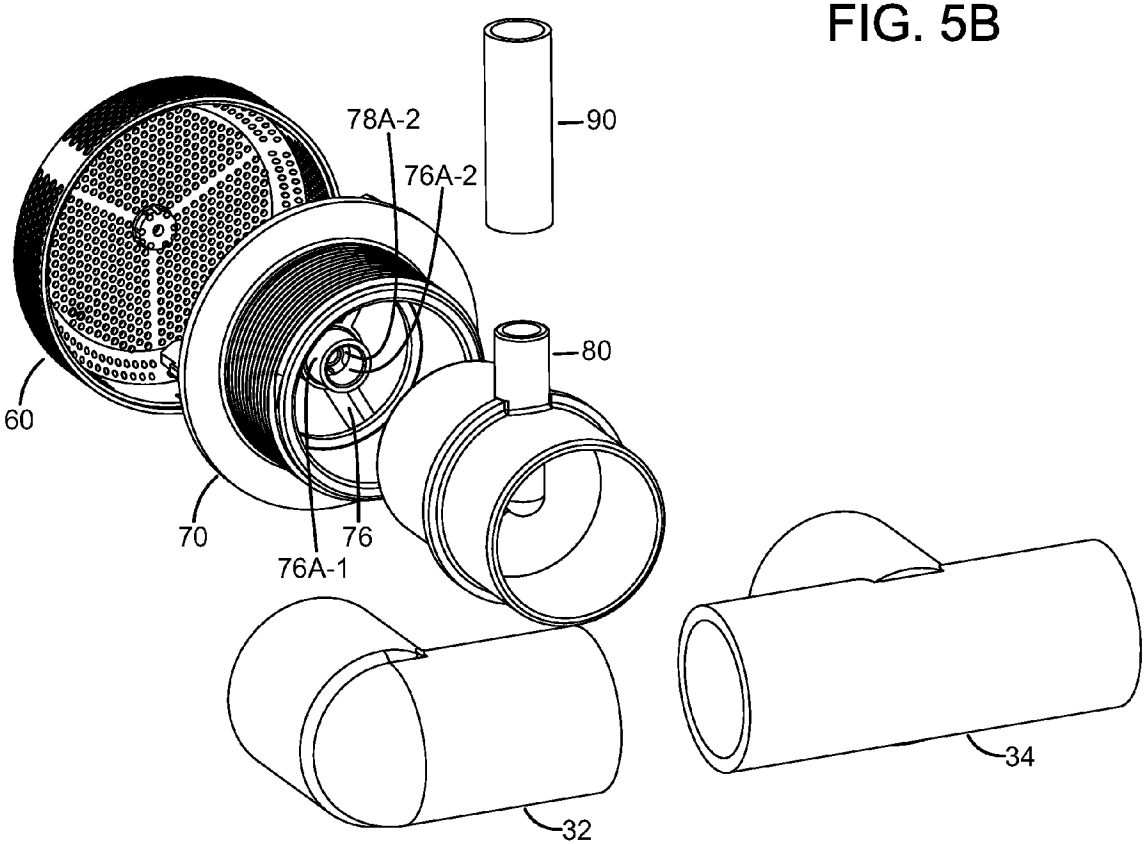
FIG. 5B is a rear isometric exploded view of the exemplary suction fitting of FIG. 3.

It will be seen, e.g. in FIG. 5A, that the tip of the tubular portion 76A is recessed from the edge of the vane portions 76, such that a gap 76C (FIG. 6A) is defined between the cover 60 and the tip of the tubular portion. In an exemplary embodiment, the gap size is 0.075 inch.

The suction fitting assembly 50 further includes a suction adapter structure 80, which includes a port 82 to which is attached an air tube 90. A function of the suction adaptor structure is to admit air through the tube 90 from the atmosphere to the line 30 during a blocked condition, in which openings in the cover 60 are blocked, e.g. by a person's hair, body or clothing, and water cannot freely enter the fitting from the water receptacle. Air from the tube will be drawn into the water line and pump in this condition, causing a cavitation-like condition in the pump, such that the pump loses prime and render its operation ineffective. As a result, the suction force on the cover is greatly reduced, and should allow ready removal of the blockage from the cover. During normal operation, i.e. with the cover openings not blocked, water standing in the tube 90 will block air from passing through the tube into the adapter structure and to the pump, allowing normal pump operation. The function will be described further below.

The suction adapter structure 80 includes generally cylindrical hollow body portions 84A and 84B (FIG. 5A). The outer diameter (OD) of the body portion 84A is sized for a pipe slip fit connection into the open end of the wall fitting structure 70, and is thus slightly smaller than the inner diameter (ID) of the open end of the wall fitting. In an exemplary embodiment, this connection may be made after the wall fitting has been secured in the wall opening by the nut 100. The adapter structure may be secured to the housing structure by adhesive, in an exemplary embodiment. In an exemplary embodiment, the OD of portion 84A and the ID of the housing structure 70 are non-standard sizes, to prevent the connection of the housing structure 70 to a pipe of standard size to prevent connection of the wall fitting directly to the bathing installation pipe system without the use of the adapter structure. In one implementation the OD and ID are each greater than 2 inch standard schedule 40 pipe fittings and less than 2.5 inch standard schedule 40 pipe fittings, e.g. 2.8 inches for the OD of the adapter structure, but of course other non-standard sizes may alternatively be employed.

Figure 7:
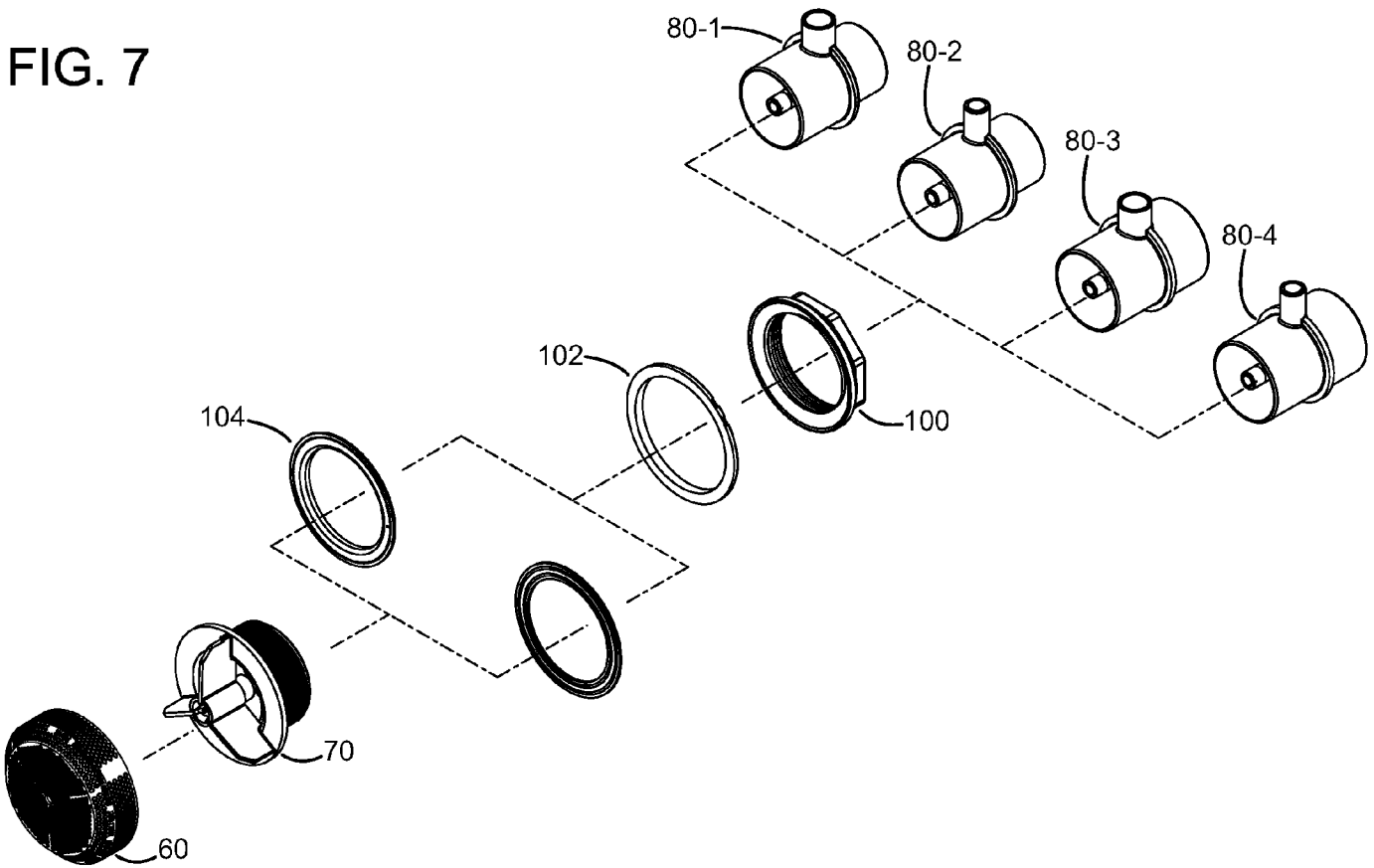
FIG. 7 is an exploded isometric view of an exemplary embodiment of a suction fitting with alternate adapter components.

The opposite body portion 84B of the adapter structure is configured with a standard size OD, so that it may be connected by a pipe slip coupling to a standard schedule 40 pipe fitting such as elbow 32 or Tee fitting 34 (FIG. 5A) or a straight pipe coupling, and glued in place; the suction fitting may be employed as a single suction source, or may be connection by the Tee fitting to another suction source. A Tee fitting allows one pump to be connected to two suction sources or suction fittings. Adapter structures of different OD dimensions for body portion 84B, with the same OD dimension of the body portion 84A, may be supplied to permit the wall fitting 70 and cover 60 to be used with different bathing installation pipe sizes. FIG. 7 illustrates a common wall fitting 70 configured for use with adapter structures 80-1, 80-2, 80-3, 80-4, of differing OD dimensions and styles for connection to water pipes of different sizes. For example, the port of the adapter structure may be constructed as a smooth barb for connection to flexible tubing, or in a socket form for connection to standard pipe such as schedule 40 plumbing. The OD may be in different dimensions, e.g. for connection to 2 inch or 2.5 inch schedule 40 plumbing.

The suction fitting assembly 50 further includes an air tube 90, attached to the housing adapter structure at port 92. The end 92 of the tube 90 may be attached to the port by adhesive, by a clamp, or both. The distal end 94 of the tube is positioned above the water line of the bathing installation to prevent water from discharging from the line when the pump is not in use.

Figure 4:
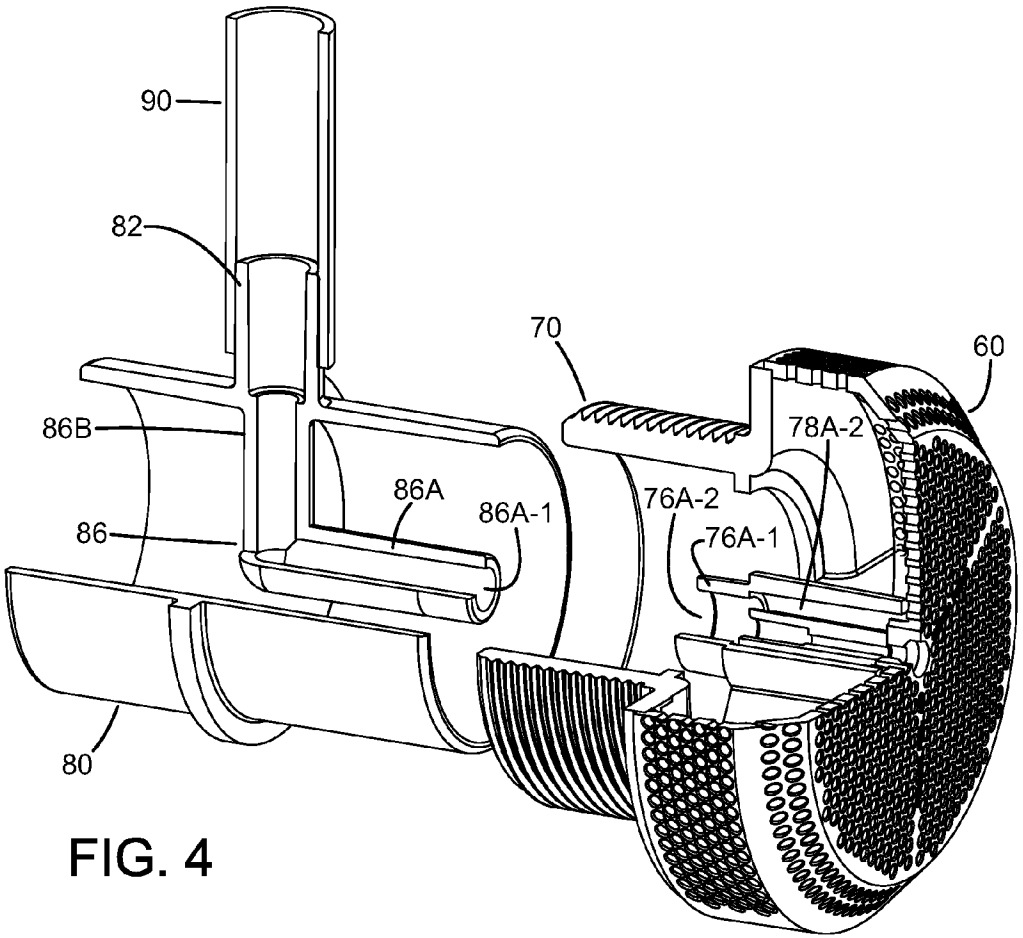
FIG. 4 is a cutaway isometric, partially exploded, view of the exemplary suction fitting of FIG. 3.

The adapter structure 80 further includes a right angle tube 86 having a tube portion 86A supported in the center of the adapter structure in a coaxial relation such that the center axis of the tube portion 86A coincides with the center axis of the adapter structure. The tube portion 86A forms a right angle with tube portion 86B which is in fluid communication with the port 82. Thus the distal opening 86A-1 (FIG. 4) of the tube 86 is in fluid communication with the port 82.

In an exemplary embodiment, the ID of the air line 90 is ¾ inch, e.g. flexible tubing; the ID of the tube 86 is ⅜ inch.

The parts 60, 70 and 80, in an exemplary embodiment, may each be unitary structures, fabricated by injection molding. The cover 60 may be fabricated from a UV resistant material, such as BASF Luran 797, also known as ASA. The wall fitting 70 and the adapter structure may each be fabricated from PVC.

When the adapter structure 80 is pushed into engagement with the wall fitting 70, the distal end of the tube portion 86A is received within the opening 76A-2 of the center support structure 76A-1. The ID of the opening 76A-2 and the OD of the tube portion 86A may be selected to provide a loose fit between the tube portion and the center support structure, or may be selected to provide a snug fit. For an example of a snug fit, the OD of the tube portion 86A may be 0.600 inch, and the ID of the flange of the center support structure may be 0.605 inch. Both parts may be tapered, so that intimate contact between the surfaces is achieved when the adapter structure is slipped into the wall fitting.

It is commonly understood that air in the suction line will prevent the pump impeller from efficiently pulling and pushing the water. Air is compressible and expandable, which dampens the vacuuming affect of the pump impeller. The pump can also loose prime, greatly diminishing pump capacity.

Figure 6A:
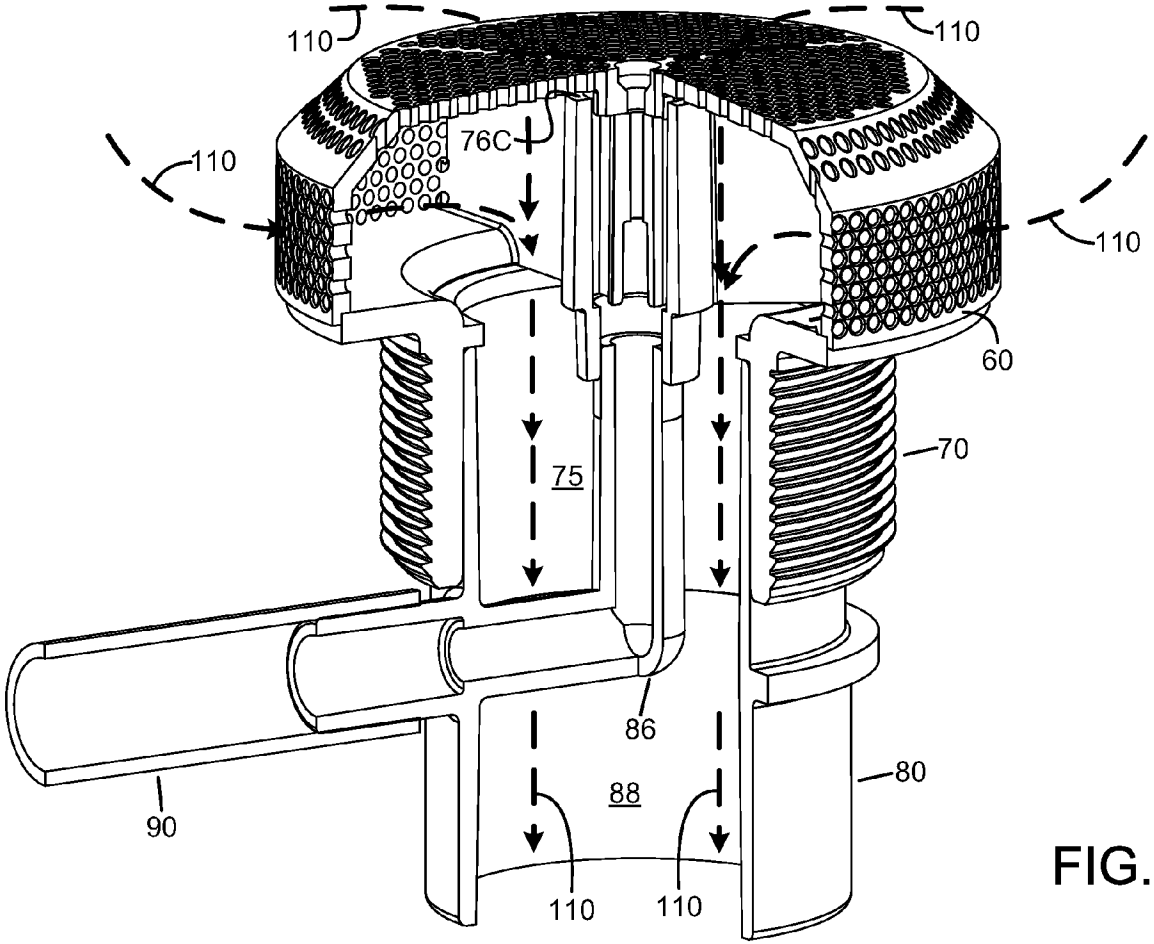
FIG. 6A is a cutaway isometric view of features of an exemplary embodiment of a suction fitting for a bathing installation, illustrating water flow in an unblocked condition.
Figure 6B:
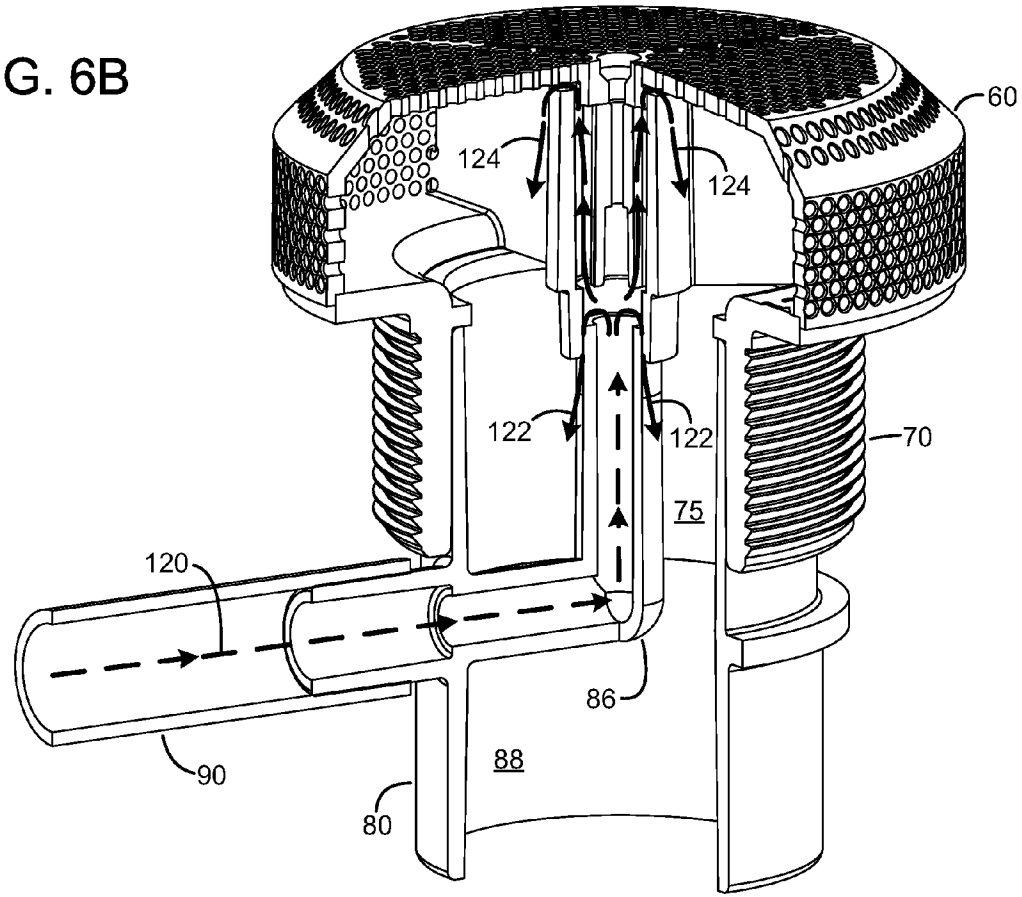
FIG. 6B is a cutaway isometric view similar to FIG. 6A, but with arrows illustrating air flow paths in a condition in which the suction fitting is blocked.

The operation of the suction fitting assembly can be further understood with reference to the figures, e.g. FIGS. 6A and 6B. When the pump is not operating, water will enter the air tube 90 through the cover orifices to the level of the water line 14 (FIG. 2) of water in the water receptacle, due to static pressure from the pressure head of the water in the receptacle. The distal end 94 of the tube 90 is positioned above the water line to prevent water from draining out the tube when the pump is not operating. Now consider the normal mode of pump operation, with the pump operating, and generating a suction or vacuum on the suction fitting assembly through the suction water line 30 (FIG. 1). In the normal mode, the cover openings are unblocked and water is drawn from the water receptacle through the cover openings 62 and through the open plenum region 75 in the wall fitting 70, the open plenum region 88 in the adapter structure 80, to the suction water line 30. The water flow in the normal mode of pump operation is illustrated in FIG. 6A by arrows 110. The size of the three gaps 76-C (FIG. 6A) is selected in relation to the area of the cover orifices within and overlying the gaps, so that the suction will pull water through the cover orifices without creating a suction completely drawing out the water in the tubes 90 and 86. For example, in an exemplary embodiment, an innermost circle of 9 orifices 62 lies within the perimeter circumscribed by the structure 76A, and another circle or ring of 15 orifices straddles the gaps 76C at the gaps 76C. In an unblocked situation, the orifices provide sufficient water flow into the fitting from the water receptacle (bath side) without drawing the water from the tubes 86 and 90. Hence, the respective areas of the cover orifices and the passages leading to the tube 86 are such that no air will be drawn into the wall fitting and adapter structure during normal operation of the pump. The water level in the tube 90 will typically remain at about the receptacle water level 14 (FIG. 2), although it could drop and still not affect operation, so long as enough water remains to block air flow out the distal end of the tube 86.

Now consider the situation in which some orifices 62 in the cover have been blocked, e.g. by a person's hair, body or clothing (not shown in FIG. 6B). If all orifices are blocked, water cannot enter the suction fitting assembly 50 from the water receptacle. If some orifices are blocked, and particularly the openings overlaying the support structure 76A, i.e. the two inner rings of orifices, the suction force applied by the pump may result in the amount of water in the tube 86 and tube 90 being drawn into the plenums 75 and 88. Now air will be drawn from the distal end of the tube 90, through the tube 86, and into the plenums 75 and 88 and to the pipe 32 and pump 20. FIG. 6B illustrates two possible paths for air flow from the tube 90 and tube 86, although one of the paths may be omitted. Air entering from tube 90 follows the path indicated by arrows 120, flowing out the distal end of the tube 86. With suction force being applied by the pump, air may be drawn between the ID of the center structure 76-1 (FIG. 2) and the OD of the tube 86, for the case in which there is a loose fit between these two structures. Air flow through this path is indicated by arrows 122. If the two elements have a snug fit, then this path of air flow will be blocked.

Another path for air flow is through the open regions 78A-2 (FIG. 4) within the center support structure 76A, up toward the cover 60 and out the gap regions 76C (FIG. 6A), between the vane portions 76, to the plenum regions 75 and 88, to the suction pipe 30 and to the pump. These open regions and other flow paths provide sufficient air flow to rapidly ingest air into the pump. Air may also exit the cover through the first and second rings or circles of concentric holes in the cover overlaying the support structure 76A and re-enter the cover through the holes in communication with the plenum 75.

The air ingested in this manner will severely reduce the pump capacity and cause the pump to lose prime, thus relieving the suction force applied to the suction fitting assembly 50. With the loss of suction force, the person's hair, body, clothing or other blocking material may be readily removed from the cover. Once the blocking is removed, the pump, which continued to run, will eventually regain prime and its pump capacity, and normal operation automatically resumes. When the pump loses prime, water may re-enter the air tube 90 and reach the level of the water in the receptacle. Water is able to enter the tube, but this depends on the availability of water to the tube, i.e. water seeks equilibrium. If the cover is still blocked, the water may again be drawn out of the tube as the pump operation attempts to regain operation, leading to air again entering the water line and causing air ingestion. In an exemplary embodiment, water is not forced under pressure, by normal pump operation, into the air tube 90, so that a check valve may not be used to prevent water from pouring out the open tube end during pump operation. Check valves can fail, disabling the safety feature. An exemplary embodiment of the suction fitting assembly allows the air tube 90 and tube 86 to be in close proximity with the bather side of the suction. By having some space between the air tube arrangement and the suction fitting cover, air can be pulled to the pump without having to exit the suction fitting cover.

Large pumps, e.g. pumps having a 200 gpm capacity, require a large amount of air to break the vacuum. The ID of the air tube 90 and tube 86 is selected to be sufficiently large to allow a relatively large amount of air to be rapidly ingested to break the vacuum.

Exemplary embodiments of the suction fitting may be efficiently installed in a wall of the water receptacle. One exemplary installation method includes the steps of:

(i) inserting a generally cylindrical hollow barrel portion of a wall fitting structure into an opening formed in the wall from a water side of the wall, the opening below the water level of water in the receptacle, such that a flange portion formed at an end of the barrel portion is brought into engagement with the wall periphery or a gasket to sealingly engage the wall opening, the wall fitting structure having a first end for attachment of a suction cover;

(ii) securing the wall fitting structure to the wall by threadingly engaging a fastener onto a threaded portion of the outer periphery of the hollow barrel portion from the dry side of the wall;

(iii) inserting a generally cylindrical first hollow body portion of a suction adapter structure into an open second end of the wall fitting structure from the dry side of the wall, the adapter structure including a second generally cylindrical hollow body portion axially aligned with the first hollow body portion, the outer diameter (OD) of the first body portion sized for a slip fit connection into the open second end of the wall fitting structure, the second body portion terminating in a suction fitting port configured for connection to a fluid conduit in fluid communication with a suction port of the pump;

(iv) adhesively sealing the first body portion of the suction adapter structure to the wall fitting;

the suction adapter structure further including a tube structure having a first tube portion supported in the center of the adapter structure in a coaxial relation such that a center axis of the first tube portion generally coincides with a center axis of the adapter structure, the tube further including a second tube portion forming an angle with the first tube portion and in fluid communication with an air port formed on the second body portion of the adapter structure;

(v) attaching a first end of an air conduit to the air port and arranging the air conduit so that a distal end of the air conduit open to the atmosphere is positioned above a filled water level in the water receptacle installation to prevent water from discharging from the line when the pump is not in use;

(vi) attaching a suction cover to the first end of the wall fitting structure, the cover having a pattern of holes or orifices formed therein to allow water to enter the fitting in normal operation while preventing objects larger than the hole from being sucked into the fitting during pump operation;

(vii) so that with the pump turned off, water enters into the suction fitting from the water receptacle and into the air conduit to a level of about the receptacle water level, and with the pump turned on in normal operation in which the suction cover openings are not blocked, water is drawn down the air conduit, with sufficient water remaining to block entrance of air into the tube from the air conduit, and during a blockage condition when some or all the openings in the suction cover are blocked during pump operation, water in the air conduit is drawn out and air is drawn from the atmosphere through the air conduit and out the suction port fitting, causing the pump to cavitate so the blockage may be removed.

Exemplary embodiments of the suction fitting assembly may provide one or more of the following benefits and advantages. In one embodiment, the air ingestion rate though the air tube in a blocked condition is sufficient to rapidly cause a high flow pump such as a pump of 200 gpm capacity to lose prime, or otherwise impair function to release the suction force on the cover. Of course, the suction fitting may also be used with pumps of lower or higher capacity. This may entail tuning the sizes of the orifices and air flow gaps (76-C) to provide proper operation under higher flow rates or lower flow rates and yet avoid unnecessary cavitations of the pump in an unblocked condition. In another embodiment, the suction fitting assembly may be used in spas and other bathing assemblies without redesign of the water flow system, i.e. to add additional suction fittings, to comply with governmental requirements. A further advantage of an exemplary embodiment is that the assembly and its operation may be independent of variations in the wall thickness of the receptacle (tub or shell in the case of a spa). The gap 76-C size, for example, does not vary as the wall thickness varies. Rather, the position of the cover to the wall fitting is registered by the depth of center boss 66 (FIG. 2) of the cover, and position of the tip of the inner structure 78A in relation to the tip of the outer structure 76A. The boss 66 is brought into contact against the tip of the structure 78A, registering the cover position in relation to the wall fitting. The gap dimension will not vary due to installation variations, e.g. in the wall thickness. This results in repeatable performance of the suction fitting over many different installations with capacity variations from piece to piece in pumps.

The air orifices may be established in alternate ways, in addition to the gap 76-C. For example, another boss or protrusion in the cover may be employed to enter or cooperate with a corresponding tube, forming part of the wall fitting, with grooves formed in the cover boss to define the air bleed passages.

Although the foregoing has been a description and illustration of specific embodiments of the subject matter, various modifications and changes thereto can be made by persons skilled in the art without departing from the scope and spirit of the invention.

What is claimed is:

1. A suction fitting assembly configured for fitting into a hole in a wall of a bathing installation water receptacle for drawing water from the bathing installation water receptacle to a pump, comprising:

a suction cover with a pattern of holes or orifices formed therein to allow water to enter the fitting in normal operation while preventing objects larger than the hole from being sucked into the fitting during pump operation;

a wall fitting structure having a generally cylindrical hollow barrel portion with an outer diameter smaller than a diameter of the wall opening, and a flange portion formed at an end of the barrel portion, the flange portion having an outer diameter larger than the wall opening diameter, providing a stop surface, the wall fitting structure having a first end for attachment of the suction cover and an open second end;

the wall fitting structure further including a center support structure defining a hollow center passageway, and wherein at least one open area is defined adjacent a first end of the passageway and the suction cover, and the passageway having an open tubular second end;

a suction adapter structure including axially aligned, generally cylindrical, first and second hollow body portions, the outer diameter (OD) of the first body portion sized for fitting into the open second end of the wall fitting structure, the second body portion terminating in a suction fitting port configured for connection to a fluid conduit in fluid communication with a suction port of the pump, and wherein the suction fitting port is axially aligned with the wall fitting structure to be generally transverse to the receptacle wall and provide a straight fitting assembly;

the suction adapter structure further includes a tube structure having a first tube portion supported in the center of the adapter structure in a coaxial relation such that a center axis of the first tube portion generally coincides with a center axis of the adapter structure, the tube further including a second tube portion forming an angle with the first tube portion and in fluid communication with an air port formed on one of the first and second body portions of the adapter structure, the first tube portion being sized to fit within the open tubular end of said passageway;

an air conduit having a first end attached to the air port of the adapter structure and a distal end positioned above the water line of the bathing installation to prevent water from discharging from the line when the pump is not in use, the distal end open to the atmosphere and free of check valves;

so that with the pump turned off, water enters into the suction fitting from the water receptacle and into the air conduit to a level of about the receptacle water level, and with the pump turned on in normal operation in which the suction cover openings are not blocked, water is drawn down the air conduit, with sufficient water remaining to block entrance of air into the passageway from the air conduit, and during a blockage condition when some or all the openings in the suction cover are blocked during pump operation, water in the air conduit is drawn out and air is drawn from the atmosphere through the fluid conduit and out the suction port fitting, causing the pump to cavitate so the blockage may be removed.

2. The fitting of claim 1, wherein the OD of the first body portion of the adapter structure is sized for a pipe slip fit connection into the open end of the wall fitting structure for sealing engagement.

3. The fitting of claim 1, wherein the OD of the first body portion of the adapter structure and an inner diameter of the open end of the wall fitting structure are non-standard sizes to prevent connection of the wall fitting structure to a pipe of standard size.

4. The fitting of claim 3, wherein the OD and ID are each greater than 2 inch standard schedule 40 pipe fittings and less than 2.5 inch standard schedule 40 pipe fittings.

5. The fitting of claim 3, wherein the second body portion of the adapter structure is configured with a standard pipe size OD or ID, so that it may be connected by a pipe slip coupling to a standard size pipe fitting.

6. The fitting of claim 5, wherein the standard pipe size OD is for a male fitting, and the standard size pipe fitting has a female fitting for pipe slip coupling to said second body portion.

7. The fitting of claim 3, further comprising a second suction adapter structure including axially aligned, generally cylindrical, first and second hollow body portions, the outer diameter (OD) of the first body portion sized for fitting into the open second end of the wall fitting structure, the second body portion terminating in a suction fitting port, and wherein the suction fitting port of the second suction fitting adapter structure has a different OD than the suction fitting port of the suction adapter structure, allowing the wall fitting structure to be assembled to either said suction fitting adapter or said second suction fitting adapter.

8. The fitting of claim 1, wherein during a blockage condition, air is drawn from the air conduit through at least one air flow path into an open plenum region in the wall fitting and an open plenum region in the adapter structure.

9. The fitting of claim 8, wherein said at least one air flow path includes an air flow path from air conduit, said passageway and through said at least one open area into said open plenum region in said wall fitting.

10. The fitting of claim 9, wherein said at least one air flow path includes an air flow path from said air conduit, an open space between said the first tube portion and the open tubular end of said passageway.

11. The fitting of claim 8, wherein the at least one air flow path includes a first air flow path from air conduit, said passageway and through said at least one open area into said open plenum region in said wall fitting, and a second air flow path from said air conduit, an open space between said the first tube portion and the open tubular end of said passageway.

12. The fitting of claim 1, wherein sizes of the at least one open area are selected in relation to an area of a set of cover orifices within and overlying the at least one open region, so that pump suction in normal operation will pull water through the cover orifices without creating a suction completely drawing out the water in the air conduit and said tube of said suction adapter structure.

13. The fitting of claim 1, wherein the bathing installation is a spa, and an inner dimension of the air conduit and an inner dimension (ID) of the tube are selected to be sufficiently large to allow a relatively large amount of air to be rapidly ingested to cause cavitition of a pump having a nominal pump flow rating of at least 200 gallons per minute.

14. The fitting of claim 13, wherein a nominal dimension of the ID of the air conduit is ¾ inch.

15. The fitting of claim 1, further including a plurality of vane portions integrally formed with the flange portion and protruding radially outward from the center support structure center to support the center support structure, with outer edge portions of the plurality of vane portions contoured to conform to a shape of corresponding inner surfaces of the cover.

16. The fitting of claim 1, wherein dimensions of said at least one open area are independent of a thickness of said water receptacle wall.

17. The fitting of claim 16, wherein an installed position of the cover to the wall fitting structure is registered by a contact between a center boss of the cover and a tip of the center support structure.

18. A suction fitting assembly fitted into a hole in a wall of a bathing installation water receptacle for drawing water from the bathing installation water receptacle to a pump, comprising:

a suction cover with a pattern of holes or orifices formed therein to allow water to enter the fitting in normal operation while preventing objects larger than the hole diameter from being sucked into the fitting during pump operation;

a wall fitting structure having a generally cylindrical hollow barrel portion with an outer diameter smaller than a diameter of the wall opening, and a flange portion formed at an end of the barrel portion, the flange portion having an outer diameter larger than the wall opening diameter, providing a stop surface which engages a water side surface of the wall, the wall fitting structure having a first end for attachment of the suction cover and an open second end, and wherein an outer portion of the hollow barrel portion is threaded;

the wall fitting adapter further including a center support structure defining a hollow center passageway, and wherein open areas are defined between a first end of the passageway and the suction cover, and the passageway having an open tubular second end;

a suction adapter structure including axially aligned, generally cylindrical, first and second hollow body portions, the outer diameter (OD) of the first body portion sized for a pipe slip fit connection into the open second end of the wall fitting structure, the OD of the first body portion sized for a pipe slip fit connection into the open end of the wall fitting structure for sealing attachment thereto, the second body portion terminating in a suction fitting port configured for connection to a fluid conduit in fluid communication with a suction port of the pump;

the suction adapter structure further including includes a tube having a first tube portion supported in the center of the adapter structure in a coaxial relation such that a center axis of the first tube portion generally coincides with a center axis of the adapter structure, the tube further including a second tube portion in fluid communication with an air port formed on the second body portion of the adapter structure, the first tube portion being sized to fit within the open tubular end of said passageway;

an air conduit having a first end attached to the air port of the adapter structure and a distal end positioned above the water line of the bathing installation to prevent water from discharging from the line when the pump is not in use;

so that with the pump turned off, water enters into the suction fitting from the water receptacle and into the air conduit, and with the pump turned on in normal operation in which the suction cover openings are not blocked, water is drawn down the air conduit, with sufficient water remaining in the air conduit to block entrance of air into the suction fitting from the air conduit, and during a blockage when some or all the openings in the suction cover are blocked during pump operation, water in the fluid conduit is drawn out and air is drawn from the atmosphere through the air conduit and out the passageway, causing the pump to cavitate so the blockage may be removed; and wherein the OD of the first body portion of the adapter structure and an inner diameter of the open end of the wall fitting structure are non-standard sizes to prevent connection of the wall fitting structure to a pipe of standard size.

19. The fitting of claim 18, wherein the distal end of the air conduit is open to the atmosphere and free of a check valve.

20. The fitting of claim 18, wherein the suction fitting port of the second body portion of the adapter structure is configured with a standard pipe size OD or ID, so that it may be connected by a pipe slip coupling to a standard size pipe fitting, and wherein the standard size OD or ID is selected from one of a plurality of standard size ODs or IDs, such that the wall fitting is configured for assembly to any one of a plurality of adapter structures of different sized suction fitting ports.

21. The fitting of claim 18, wherein the bathing installation is a spa.

22. The fitting of claim 21, wherein an inner dimension of the air conduit and an inner dimension (ID) of the tube are selected to be sufficiently large to allow a relatively large amount of air to be rapidly ingested to cause cavitition of a pump having a nominal pump flow rating of at least 200 gallons per minute.

23. A method for installing a suction fitting into a wall of a bathing installation water receptacle, the wall having a water side and a dry side, the method comprising a sequence of the following steps:

inserting a generally cylindrical hollow barrel portion of a wall fitting structure into an opening formed in the wall from a water side of the wall, the opening below the water level of water in the receptacle, such that a flange portion formed at an end of the barrel portion is brought into engagement with the wall periphery or a gasket to sealingly engage the wall opening, the wall fitting structure having a first end for attachment of a suction cover;

securing the wall fitting structure to the wall by threadingly engaging a fastener onto a threaded portion of the outer periphery of the hollow barrel portion from the dry side of the wall;

inserting a generally cylindrical first hollow body portion of a suction adapter structure into an open second end of the wall fitting structure from the dry side of the wall, the adapter structure including a second generally cylindrical hollow body portion axially aligned with the first hollow body portion, the outer diameter (OD) of the first body portion sized for a slip fit connection into the open second end of the wall fitting structure, the second body portion terminating in a suction fitting port configured for connection to a fluid conduit in fluid communication with a suction port of a pump, adhesively sealing the first body portion of the suction adapter structure to the wall fitting;

the suction adapter structure further including a tube structure having a first tube portion supported in the center of the adapter structure in a coaxial relation such that a center axis of the first tube portion generally coincides with a center axis of the adapter structure, the tube further including a second tube portion forming an angle with the first tube portion and in fluid communication with an air port formed on the second body portion of the adapter structure;

attaching a first end of an air conduit to the air port and arranging the air conduit so that a distal end of the air conduit open to the atmosphere is positioned above a filled water level in the water receptacle installation to prevent water from discharging from the line when the pump is not in use;

attaching a suction cover to the first end of the wall fitting structure, the cover having a pattern of holes or orifices formed therein to allow water to enter the fitting in normal operation while preventing objects larger than the hole from being sucked into the fitting during pump operation;

so that with the pump turned off, water enters into the suction fitting from the water receptacle and into the air conduit to a level of about the receptacle water level, and with the pump turned on in normal operation in which the suction cover openings are not blocked, water is drawn down the air conduit, with sufficient water remaining to block entrance of air into the tube from the air conduit, and during a blockage condition when some or all the openings in the suction cover are blocked during pump operation, water in the air conduit is drawn out and air is drawn from the atmosphere through the air conduit and out the suction port fitting, causing the pump to cavitate so the blockage may be removed.

24. The method of claim 23, wherein the wall fitting structure further including a center support structure defining a hollow center passageway, and wherein at least one open area is defined adjacent a first end of the passageway and the suction cover, and the passageway having an open tubular second end, and wherein:

said step of inserting the generally cylindrical first hollow body portion of the suction adapter structure into the open second end of the wall fitting structure includes inserting an open end of the first tube portion into an open first end of a passageway formed in the wall fitting structure, the passageway having a distal end in which open areas are formed adjacent the cover.

25. The method of claim 24, wherein said step of attaching the cover to the wall fitting includes:

registering the installed position of the cover to the wall fitting by bringing a center boss of the cover into contact with the distal end of the passageway, such that a gap dimension of the open areas will not vary due to variations in thickness of the wall.

26. The method of claim 23, wherein after said step of adhesively sealing the first body portion of the suction adapter structure to the wall fitting, the suction fitting port is axially aligned with the wall fitting structure to be generally transverse to the receptacle wall.

* * * * *